United States Patent [19]

Brindley

[11] 4,276,703

[45] Jul. 7, 1981

[54] CALENDAR APPARATUS

[76] Inventor: Donald J. Brindley, 806 SE. Sharon Dr., Ankeny, Iowa 50021

[21] Appl. No.: 103,070

[22] Filed: Dec. 12, 1979

[51] Int. Cl.[3] ..... G09D 3/04

[52] U.S. Cl. ..... 40/121; 40/120; 40/122

[58] Field of Search ..... 40/107, 120, 121, 122, 40/124.1

[56] References Cited

U.S. PATENT DOCUMENTS

| | | | |
|---|---|---|---|
| 2,003,142 | 5/1935 | Fisher | 40/107 |
| 2,755,582 | 7/1956 | Nichols | 40/122 X |
| 3,032,904 | 5/1962 | Washburn | 40/122 |
| 3,113,559 | 12/1963 | Friedman | 40/120 |
| 3,290,812 | 12/1966 | Hunkins | 40/107 |
| 3,534,489 | 10/1970 | Diambra et al. | 40/122 |

FOREIGN PATENT DOCUMENTS

| | | | |
|---|---|---|---|
| 558666 | 7/1957 | Belgium | 40/120 |
| 554402 | 3/1958 | Canada | 40/120 |
| 28352 | of 1909 | United Kingdom | 40/107 |

*Primary Examiner*—John F. Pitrelli

*Attorney, Agent, or Firm*—Henderson & Sturm

[57] ABSTRACT

This invention relates to collapsible display members in general and more specifically to a personalized calendar suitable for mailing to current or prospective clients having a plurality of recesses, slots and pivotable members which allow various items to be displayed upon the calendar, and which provide support surfaces for maintaining the display surfaces in an upright position.

1 Claim, 5 Drawing Figures

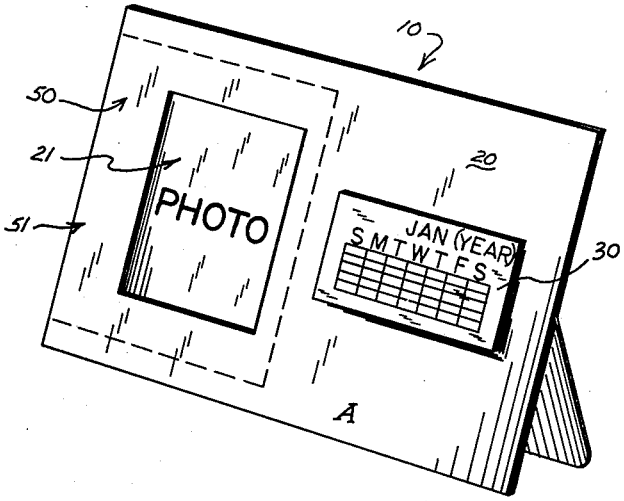
FIG. 1
FIG. 2
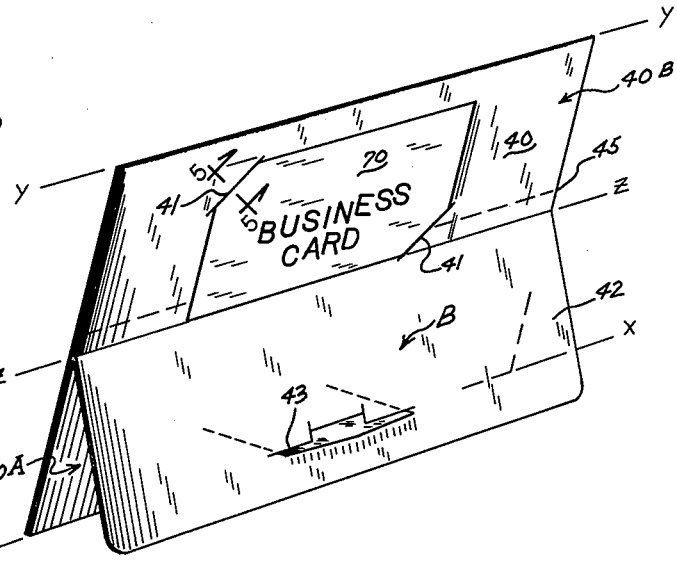
FIG. 5
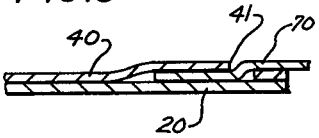
FIG. 3
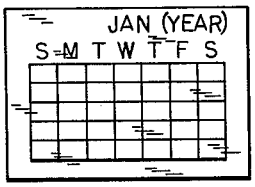
FIG. 4
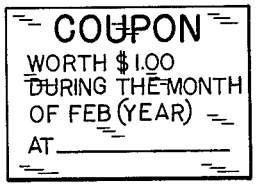

CALENDAR APPARATUS

BACKGROUND OF THE INVENTION

This invention relates to the area of promotional display items wherein a business entity mails printed material bearing its company logo or name, to either established or potential customers. The item normally perform some functional duty and are intended to be utilized and displayed by the customer, whereby the business entities name or logo are constantly visible. The purpose for such display items is to keep the customer, constantly if only on a subconscious level, exposed to the business entities trade name or trademark, to promote product or service identification, and presumably result in future sales activity.

Some of the problems associated with the prior art devices are the lack of a "personal touch," the failure to utilize the full advertising potential of the display item, the use of cheap or inexpensive materials which cause the customer to immediately discard the item, thereby thwarting any potential benefit to the sender, and the lack of ingenuity in the design and configuration of the item to disguise its commercial aspect and insure that the envelope in which the item is mailed is indistinguishable from personal or business correspondance.

SUMMARY OF THE INVENTION

An object of the present invention is the provision of a promotional display item which when inserted into an envelope is indistinguishable from personal or business correspondence.

A further object of this invention is the provision of a collapsible promotional display item which allows a photograph, business card, invitation or special message to be inserted into appropriate recesses.

Another object of the present invention is the provision of a promotional display item which has a calendar portion which serves a dual function, in that the back of each sheet bearing the individual months serves as an additional promotional element.

Yet another object of this invention is the provision of a collapsible display item which in its assembled relationship is capable of supporting itself in the upright position, and yet assumes a very low profile in the collapsed state.

A still further object of this invention is the provision of a promotional display item which avoids all of the drawbacks of the prior art, while accomplishing all of the objectives stated supra.

BRIEF DESCRIPTION OF THE DRAWINGS

FIG. 1 is a front perspective view of the promotional display item in its assembled relationship;

FIG. 2 is a rear perspective view of the promotional display item in its assembled relationship;

FIG. 3 is a representation of the face of a typical calendar sheet;

FIG. 4 is a representation of the rear of a typical calendar sheet bearing the additional promotional element; and FIG. 5 is a detailed cross-sectional view of one of the slots at the rear of the display item, and its relationship with a removable element, taken through line 5—5 of FIG. 2.

DESCRIPTION OF THE PREFERRED EMBODIMENT

As can be seen by reference to FIG. 1 the promotional display item is designated generally as 10 and comprises a face portion 20 having a calendar 30 attached thereto, and is further provided with a geometrically shaped aperture 21 whose purpose and function will be explained further on. The display item 10 also comprises a rear portion 40 having a plurality of angled slots 41 and a flap member 42 depending therefrom having a horizontal slot 43 disposed therein.

The body of the display item 10 is formed from a single piece of rigid cardboard or similar material which is folded and glued at appropriate locations to create the structure herein defined.

The lower rear portion 40 initiates at 45 (dashed lines) and proceeds until it is creased or folded upon itself along line x—x; whereupon it becomes the face portion 20. The face portion 20 proceeds until it is creased or folded upon itself along line y—y; whereupon it becomes the upper rear portion 40B. The upper rear portion 40B is further creased along line z—z to form the flap member 42.

The lower rear portion 40A of the display item 10 has a U-shaped slot (not shown) which forms a flap element 47. The flap element 47 is configured to fit inside the slot 43 in the flap member 42 to support the display item, in a well known manner, in the position illustrated in FIG. 2.

The abutting surfaces of the face portion 20 and the rear portion 40 are adhesively secured to one another with the exception of, the area designated as 50 and represented by the dashed lines in FIG. 1, and the flap element 47. The area 50 forms an opening or pocket 51 between the abutting surfaces of the face portion 20 and the rear portion 40. The envelope 51 is configured to receive a photograph or similar insertable item which is visible through the aperture 21 in the face portion 20 of the display item.

Positioned to one side of the aperture 21 is a calendar element 30 comprising a plurality of individual sheets 31 releasably secured together and affixed to the face portion 20. As can be seen in FIGS. 3 and 4, each sheet 31 of the calendar 30 has a different month imprinted on its face 32 and coupon imprinted on its rear 32 which is valid for the succeeding month.

The surface area A of the face portion 20 which is not covered by the calendar 30 presents a surface upon which commercial advertising may be imprinted.

Referring now to FIGS. 2 and 5, it can be seen that the rear portion 40 has a plurality of angled slots 41 which releasably receive an item 70 bearing commercial indicia such as a business card, photograph, invitation, or special message, and presents a surface area B, which is not covered by the item 70, upon which commercial advertising such as messages, slogans, etc. may be imprinted.

It should be appreciated by now that the display item herein described, provides a relatively flat collapsible display item which can be inserted in a plain envelope bearing a handwritten address so that it bears the external semblance of a personal seasonal greeting card. The item further provides recesses for releasably securing and partially enveloping a plurality of elements such as personal business cards and photographs, while further utilizing detachable sheets which will function as promotional coupons once their primary function as a calendar element has been served.

Having thereby disclosed the subject matter of this invention it should be obvious that many modifications, substitutions, and variations of the invention are possible in light of the above teachings. It is therefore to be understood that the invention may be practiced other than as specifically described, and should be limited only by the breadth and scope of the appended claims.

I claim:

1. A collapsible display item comprising:

a self-supporting, rigid, one piece body having a face portion and a rear portion, said face portion and said rear portion having abutting surfaces adhesively secured to each other along the extreme top, bottom and one end thereof;

shaped aperture means disposed in said face portion, extending through said face portion to said rear portion for holding and displaying a picture;

pocket means formed by the other side of the face and rear portions for allowing the other end of the face and rear portions to be temporarily separated for selectively allowing a picture to pass between said other side of the face and rear portions to or from said aperture means;

a calendar disposed on said face portion, said calendar comprising a plurality of detachable sheets secured to said face portion, and each of said sheets having a different month imprinted on its face, and a promotional coupon imprinted on the rear side thereof;

said rear portion having means including four spaced straight slots disposed therein, for releasably securing a printed promotional item therein, two of said slots being parallel with respect to each other and perpendicular with respect to the other two slots;

a flap member depending from said upper rear portion and having a horizontal slot disposed therein; and a lower rear portion having an U-shaped slot means disposed therein for forming a flap element, said flap element being configured to fit within the horizonal slot in said flap member.

* * * * *